US008741013B2

(12) United States Patent
Swett et al.

(10) Patent No.: US 8,741,013 B2
(45) Date of Patent: Jun. 3, 2014

(54) DUST BIN FOR A ROBOTIC VACUUM

(75) Inventors: David Orrin Swett, Waltham, MA (US); Mark Steven Schnittman, Somerville, MA (US)

(73) Assignee: iRobot Corporation, Bedford, MA (US)

( * ) Notice: Subject to any disclaimer, the term of this patent is extended or adjusted under 35 U.S.C. 154(b) by 299 days.

(21) Appl. No.: 13/341,334

(22) Filed: Dec. 30, 2011

(65) Prior Publication Data

US 2012/0199006 A1 Aug. 9, 2012

Related U.S. Application Data

(60) Provisional application No. 61/428,843, filed on Dec. 30, 2010.

(51) Int. Cl.
*B01D 46/00* (2006.01)

(52) U.S. Cl.
USPC ..... 55/418; 55/428; 55/429; 55/471; 55/482; 55/DIG. 3; 15/319; 15/340.1; 15/347; 15/352

(58) Field of Classification Search
CPC ..... A47L 9/14; B01D 46/0019
USPC ..... 15/300.1, 319, 323, 324, 325, 326, 15/327.1, 327.2, 327.6, 327.7, 330, 340.1, 15/345, 347–352, 412; 55/DIG. 3, 471, 55/429, 509, 502, 501; 96/417
See application file for complete search history.

(56) References Cited

U.S. PATENT DOCUMENTS

| | | | | |
|---|---|---|---|---|
| 7,571,511 | B2 * | 8/2009 | Jones et al. | 15/319 |
| 7,620,476 | B2 * | 11/2009 | Morse et al. | 700/245 |
| 8,505,158 | B2 * | 8/2013 | Han et al. | 15/347 |
| 8,528,157 | B2 * | 9/2013 | Schnittman et al. | 15/319 |
| 8,572,799 | B2 * | 11/2013 | Won et al. | 15/319 |
| 2008/0000041 | A1 * | 1/2008 | Jones et al. | 15/319 |
| 2009/0044370 | A1 * | 2/2009 | Won et al. | 15/319 |
| 2010/0037418 | A1 * | 2/2010 | Hussey et al. | 15/319 |
| 2010/0107355 | A1 * | 5/2010 | Won et al. | 15/319 |

* cited by examiner

*Primary Examiner* — Duane Smith
*Assistant Examiner* — Sonji Turner
(74) *Attorney, Agent, or Firm* — Honigman Miller Schwartz and Cohn LLP

(57) ABSTRACT

A dust bin for a robotic vacuum comprises a dust bin frame having a cavity defined therein to receive debris, a filter frame disposed within the dust bin frame and defining two filter openings at opposite sides thereof, and a central impeller disposed adjacent to or under the filter frame to draw air from outside of the dust bin into the dust bin. The dust bin also comprises two air filters, one air filter being located on each side of the central impeller, each air filter being inserted into one of the filter openings, each filter having an overhang around a perimeter thereof that includes a sealing face to form a vacuum-assisted seal with the filter frame when air is drawn into the dust bin.

11 Claims, 12 Drawing Sheets

DUST BIN FOR A ROBOTIC VACUUM

CROSS-REFERENCE TO RELATED APPLICATIONS

This application claims the benefit of priority from U.S. Provisional Patent Application No. 61/428,843, filed Dec. 30, 2010, which is incorporated in its entirety herein by reference.

FIELD

The present teachings relate to a dust bin for a robotic vacuum. The present teachings relate more specifically to a dust bin for a robotic vacuum having an increased volume.

BACKGROUND

A concern for robotic vacuum designers and manufacturers is maximizing the volume of the robotic vacuum's dust bin. A dust bin collects hair, dirt and debris that has been vacuumed and/or swept from a floor. When a dust bin is full, it is preferable to have the robotic vacuum detect the full bin and alert the user that the bin is full and/or require that the user empty the bin before the robotic vacuum continues to operate. It can also be helpful to detect when large debris has entered the robotic vacuum, for example debris that is too large to pass through the entrance to the dust bin, although the cost of providing multiple sensors to detect both large objects and a bin full status can be prohibitive.

An impeller can be located in a robotic vacuum dust bin to pull air carrying swept dirt, hair, and debris into the dust bin. Upon entering the bin, debris settles in the bin and air exits the bin toward the impeller through a filter that cleans the air before it is pulled from the dust bin through the impeller and exits the robotic vacuum through an exhaust area to re-enter the environment. The air filter can decrease the impeller's ability to pull air through the dust bin, particularly when the filter is dirty.

Certain types of dust bins include a handle, button, lever, or the like that is pressed to release the dust bin from the robotic vacuum chassis, for example, to empty its contents. The handle can be located on an outer perimeter of a top surface of the robotic vacuum, releasing the dust bin as it is pressed downward into the robotic vacuum chassis. In certain instances, a user may attempt to carry the robotic vacuum by grabbing the robotic vacuum at the dust bin release handle, inadvertently unlatching the dust bin and potentially causing the robotic vacuum to drop from the user's hand—leaving the user holding only the dust bin.

SUMMARY

The present teachings provide a dust bin for a robotic vacuum, the dust bin comprising: a dust bin frame having a cavity defined therein to receive debris, a filter frame disposed within the dust bin frame and defining two filter openings at opposite sides thereof, and a central impeller disposed adjacent to or under the filter frame to draw air from outside of the dust bin into the dust bin. The dust bin also comprises two air filters, one air filter being located on each side of the central impeller, each air filter being inserted into one of the filter openings, each filter having an overhang around a perimeter thereof that includes a sealing face to form a vacuum-assisted seal with the filter frame when air is drawn into the dust bin.

The present teachings also provide an air filter for a robotic vacuum including an air filter frame, the air filter comprising a housing having a plurality of walls and an overhanging sealing face extending beyond at least one of the walls configured to engage with the air filter frame; pleated air filter material configured to be held within the housing; and a cover attached to the housing to retain the pleated air filter material within the housing, the cover comprising at least one retaining spring configured to engage with the air filter frame to retain the air filter within the air filter frame.

The present teachings further provide for a robotic vacuum comprising a controller, a power source, a chassis, and a dust bin configured to be installed in the chassis and having at least one pocket defined therein. The sensor assembly is configured to sense when the dust bin is full. The sensor assembly comprising at least one sensor mounted on the robotic vacuum chassis and extending into the at least one pocket when the dust bin is installed in the robotic vacuum chassis, the at least one sensor being wired directly to the robotic vacuum controller.

The present teachings still further provide a directional locking assembly for a robotic vacuum having a dust bin and a chassis in which the dust bin is installed. The directional locking assembly comprises a dust bin locking mechanism of the dust bin comprising a dust bin release, and a jam latch directly or indirectly in contact with the dust bin release at the dust bin and configured to engage the robotic vacuum chassis, the jam latch being releasable from the robotic vacuum chassis upon depression of the dust bin release. The jam latch has at least one opening defined therein and comprising resilient material disposed within the at least one opening. The direction locking assembly also comprises a detent at the robotic vacuum chassis, the detent engaging the resilient material of the jam latch to maintain the dust bin and the robotic vacuum chassis in an engaged state when the weight of the robotic vacuum chassis is applied to the dust bin locking mechanism.

Objects and advantages of the present teachings will be set forth in part in the description which follows, and in part will be obvious from the description, or may be learned by practice of the present teachings. The objects and advantages of the teachings will be realized and attained by means of the elements and combinations particularly pointed out in the appended claims.

It is to be understood that both the foregoing general description and the following detailed description are exemplary and explanatory only and are not restrictive of the present teachings, as claimed.

The accompanying drawings, which are incorporated in and constitute a part of this specification, illustrate embodiments of the present teachings and, together with the description, serve to explain the principles of the teachings.

DESCRIPTION OF THE EMBODIMENTS

Reference will now be made in detail to embodiments of the present teachings, examples of which are illustrated in the accompanying drawings.

Some robotic vacuums include a removable dust bin or cartridge as illustrated in U.S. Pat. No. 7,636,982, the disclosure of which is incorporated by reference herein in its entirety.

It may be desirable to maximize the volume of the dust bin to maximize the amount of cleaning that a robotic vacuum can accomplish or the amount of debris the robotic vacuum can accumulate before the dust bin must be emptied. Certain embodiments of the present teachings provide a robotic vacuum dust bin having an increased volume.

It may also be desirable to be able to detect when the dust bin is full, so that the robotic vacuum can stop operating before dust backs up into the robotic vacuum's cleaning head. In addition, it may be desirable for the robotic vacuum to also inform the user that the dust bin is full or that the dust bin should be emptied. Certain embodiments of the present teachings contemplate utilizing bin-full sensors located on the robot chassis, but that sit within the dust bin, for example, in pockets on either side of the dust bin.

It may further be desirable to detect when an object larger than a given size is swept into or otherwise enters the robotic vacuum cleaning head. Certain embodiments of the present teachings contemplate locating the bin-full sensors such that the sensors can also detect the entry of large objects into the robotic vacuum cleaning head.

It may still be further desirable to provide one or more air filters within the dust bin that can remove dust and debris from air pulled into the dust bin by an impeller or other vacuum source, before the air exits the dust bin. It may further be desirable to provide one or more filters that are accessible and easily removable to be cleaned and/or replaced. Preferably, substantially all of the air that enters the dust bin should be filtered before the air exits the dust bin to return to the environment.

Hair can get caught in the robotic vacuum cleaning head and, for example, wrap around the brushes of the cleaning head or otherwise clog the cleaning head, potentially causing the robotic vacuum to clean in a sub-optimal manner, cease operating, and/or send an error message to the user. The present teachings contemplate providing enough vacuum power to pull hair from the cleaning head brushes into the dust bin, thereby preventing hair from getting stuck in the cleaning head and its brushes. Indeed, it can be as beneficial or more beneficial to use vacuum power to pull debris swept by the cleaning head brushes into the dust bin than to use vacuum power to pull hair and debris directly from the floor. Dirt, debris, hair, and dust are used interchangeably herein and each is intended to include the others for the purposes of this written description.

Figure 1A:
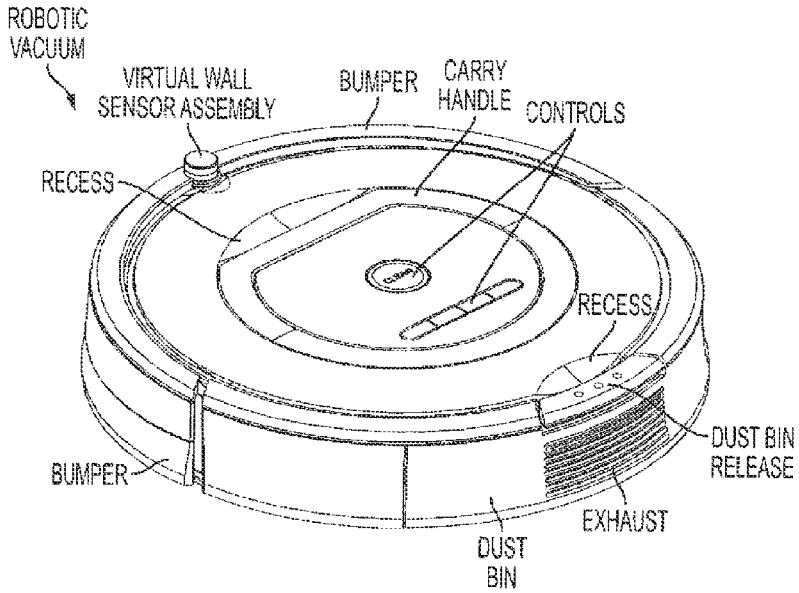
FIG. 1A is a side perspective view of an embodiment of a robotic vacuum with an installed dust bin in accordance with the present teachings.

FIG. 1A is a side perspective view of an embodiment of a robotic vacuum in accordance with the present teachings with an installed dust bin. The illustrated robotic vacuum is round and includes a chassis having a cavity in which the dust bin is removably installed during operation. The robotic vacuum may include a displaceable bumper at an outer circumferential surface thereof that cooperates with an obstacle detection sensor when the robotic vacuum collides with an object, and also provides shock absorption for such a collision. The displaceable bumper may be provided at a front portion of the outer circumferential surface of the robotic vacuum, where the front portion of the robotic vacuum is the portion of the robotic vacuum that faces forward during a routine operation of the robotic vacuum. However, the placement of the displaceable bumper is not limited thereto and may be provided at any portion of the outer circumferential surface of the robotic vacuum. In certain embodiments, a virtual wall sensing assembly is provided at a front-most top surface, for example, of the robotic vacuum to sense any virtual walls created to control the area cleaned by the robotic vacuum. The embodiment of FIG. 1A illustrates a scalloped bumper that flares outwardly. The scalloped bumper can comprise or be coated with a soft material to minimize damage or force applied to objects into which the robotic vacuum may run. The scalloped bumper is additionally aesthetically pleasing and follows the robotic vacuum's circular perimeter.

Figure 2:
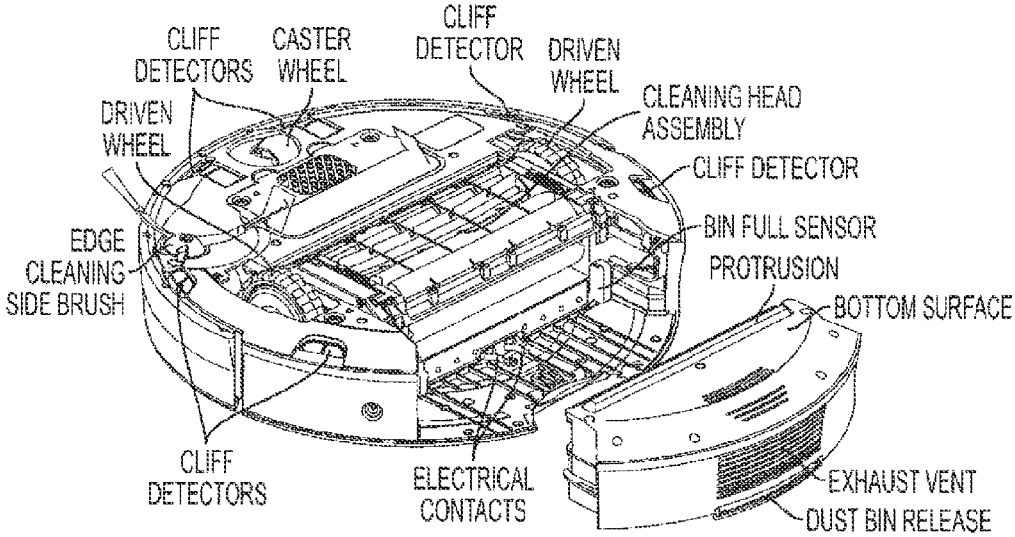
FIG. 2 is a bottom perspective view of an embodiment of a robotic vacuum with a removed dust bin in accordance with the present teachings.

Embodiments of the robotic vacuum can also include additional control sensors such as, for example, obstacle detection sensors mounted in conjunction with the bumper, wall sensors mounted in the displaceable bumper, e.g., at a right-hand and/or a left-hand portion of the displaceable bumper on a bottom surface of the robotic vacuum as shown in FIG. 2, and infrared (IR) sensors/encoders mounted in combination with one or more driven wheels (see FIG. 2). In addition, two or more cliff detectors can be provided on a bottom surface of the robotic vacuum at, for example, the front portion (see FIG. 2) to prevent the robotic vacuum from driving in a forward direction over an edge of, for example, a set of stairs.

In certain embodiments of the present teachings that allow the robotic vacuum to move in a backward direction, one or more additional cliff detectors can be provided on a bottom surface of a rear portion of the robotic vacuum to prevent the robotic vacuum from driving in a rearward direction over an edge of, for example, a set of stairs. The cliff detector(s) located at a rear portion of the robotic vacuum can, for example, be spaced from the rear-most portion of the robot about the same distance that the cliff detectors at the front portion of the robotic vacuum are spaced from the front-most portion of the robotic vacuum.

FIG. 1A also illustrates a carry handle disposed on a top surface of the robotic vacuum. The carry handle preferably sits flush with the top surface of the robotic vacuum. A grab path recess, as shown in FIG. 1A at the front portion of the robotic vacuum, can provide a grab path for the carry handle without sharp edges, and can provide the user with easier access to raise the carry handle from the top surface of the robotic vacuum, particularly if a user has large hands. The top surface of the illustrated robotic vacuum may also include various controls, for example, push buttons that allow users to control the robotic vacuum. The buttons may include, for example, one or more of a power button, a spot cleaning button, a cleaning button, and a max cleaning button or 'return to dock' button. The top surface of the robotic vacuum may also provide, for example, one or more of a status light, a battery charge indicator, a dirt detection indicator, a spot cleaning indictor, an error status indicator, a bin-full indicator, and a clock that can be used to set the current time and the robotic vacuum's autonomous 'wake up' times. Dirt detection can be provided by, for example, a dirt detection sensor (not shown) located on a bottom surface of the robotic vacuum.

FIG. 1A also illustrates a dust bin release located on a top surface of the installed dust bin. The dust bin release preferably sits flush with the top surface of the robotic vacuum. An additional recess, as shown in FIG. 1A at the dust bin at the rear portion of the robotic vacuum, can provide the user with easier access to the dust bin release (e.g., clearance for an overhanging thumb across a range of travel of the dust bin release) and can also provide a visual indication that the release is a user touch point. The rear recess can also reveal the leading edge of the dust bin release, allowing a better grasp on the dust bin release when a user is extracting the dust bin. Also located on the removable dust bin in the illustrated embodiment is an exhaust area including vents that allow air to be expelled from the robotic vacuum.

Figure 1B:
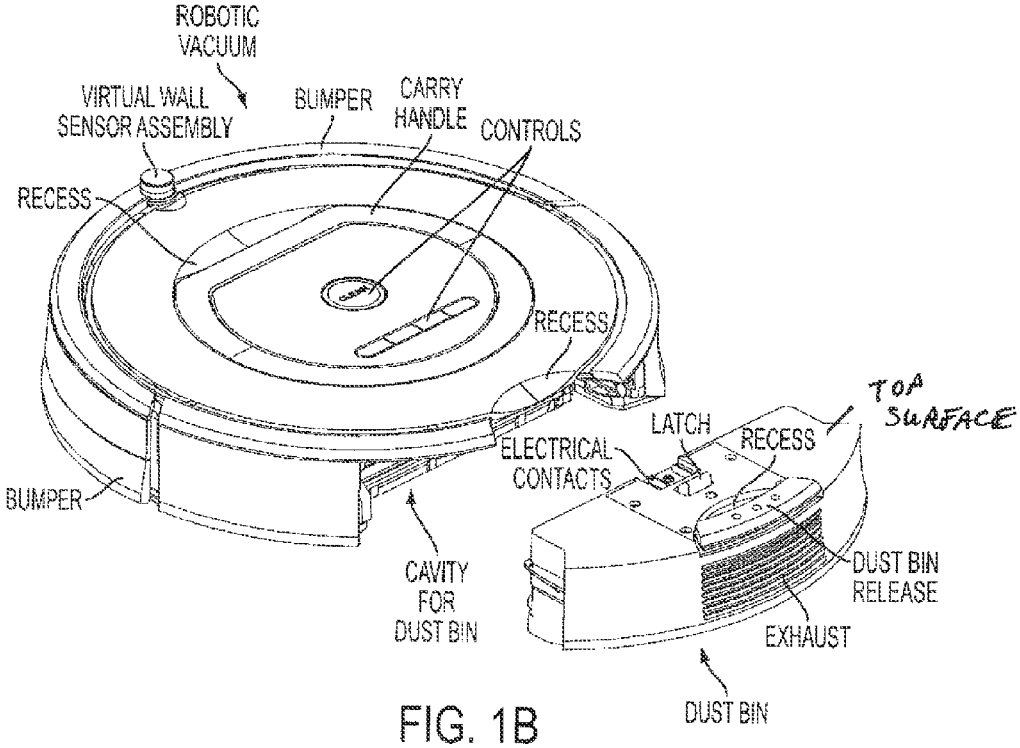
FIG. 1B is a side perspective view of an embodiment of a robotic vacuum with a removed dust bin in accordance with the present teachings.

FIG. 1B is a side perspective view of an embodiment of a robotic vacuum in accordance with the present teachings with the dust bin removed from the robotic vacuum. As shown, the dust bin fits within a cavity of the robotic vacuum chassis. A top surface of the dust bin includes the dust bin release having an adjacent dust bin recess and a latch to engage the rear recess in the robotic vacuum chassis to releasably lock the dust bin within the robotic vacuum chassis. The dust bin release is activated (e.g., by being pressed downward relative to a top surface of the robotic vacuum) to cause the latch to be released from its locked position. While an embodiment of the robotic vacuum illustrates the dust bin release on a top surface of the robotic vacuum and the rear recess in the robotic vacuum chassis, one of ordinary skill in the art would recognize that the dust bin release and latch could alternatively be located at the bottom surface of the dust bin, and the rear recess in the robotic vacuum chassis could alternatively be located at the bottom surface of the robotic vacuum, with the latch engaging the rear recess at the bottom surface of the robotic vacuum chassis.

Figure 12:
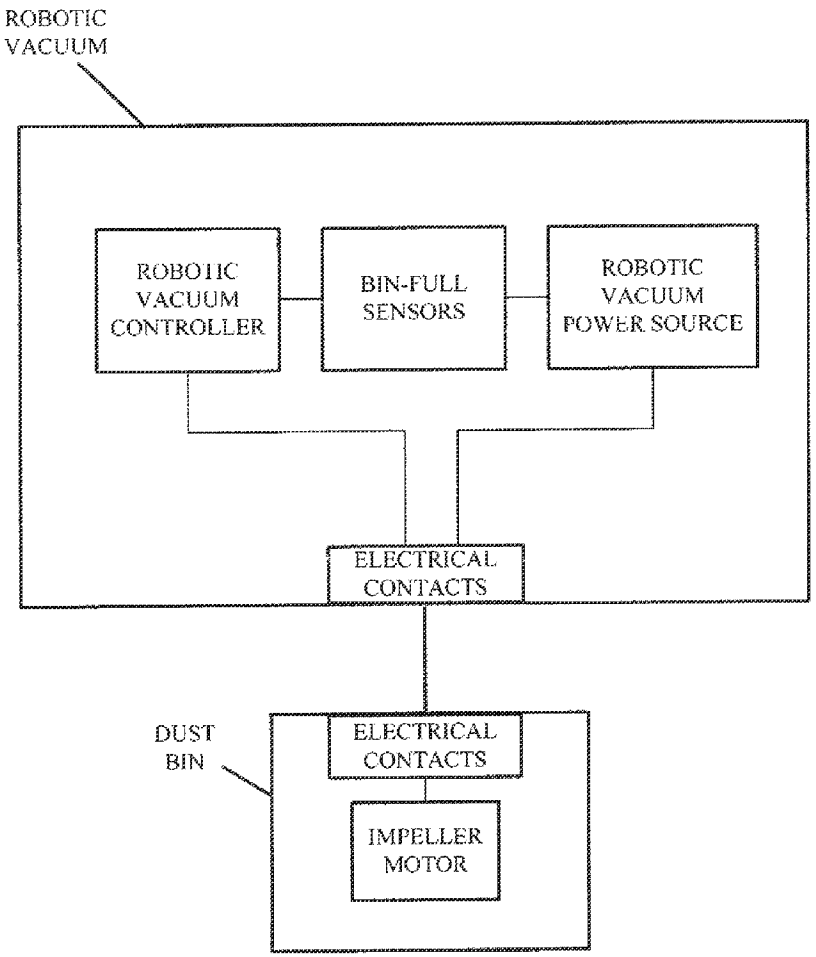
FIG. 12 is a block diagram illustrating the electrical connection between the robotic vacuum and the dust bin in accordance with the present teachings.

The top surface of the illustrated dust bin also includes electrical contacts. FIG. 12 is a block diagram illustrating the electrical connection between the robotic vacuum and the dust bin in accordance with the present teachings. The electrical contacts on the dust bin can mate with electrical contacts (see FIG. 2) provided in the robotic vacuum chassis cavity, providing power from a power source within the robotic vacuum chassis to power an impeller motor (see FIG. 5A) housed within the dust bin (see FIG. 12). The side of the illustrated dust bin includes the vented exhaust area.

FIG. 2 is a bottom perspective view of an embodiment of a robotic vacuum with a removed dust bin. The robotic vacuum includes at least two driven wheels and may include a caster wheel. As shown, a bottom surface of the robotic vacuum can include, for example, six cliff detectors, two of the cliff detectors at a foremost position on the robotic vacuum (on opposing sides of the caster wheel), one cliff detector just forward of each driven wheel, and one cliff detector just rearward of each driven wheel. A cleaning head assembly, which typically includes one or more brushes or wipers, is located just forward of the dust bin cavity and between the driven wheels, and a vacuum air inlet is formed between the cleaning head assembly and the foremost portion of the dust bin when the dust bin is installed. A protrusion that runs along a bottom surface of the dust bin can act as a float to prevent the robotic vacuum from digging its brushes into carpet, and can also help to increase suction through the air inlet. This type of protrusion can also be referred to as a carpet float. The protrusion can cooperate with a bottom surface of the robotic vacuum and the vacuum source, e.g., the impeller, to define an airflow channel (see FIGS. 11A and 11B). The protrusion illustrated herein is not intended to contact the floor, although contact may occur during use.

Figure 3A:
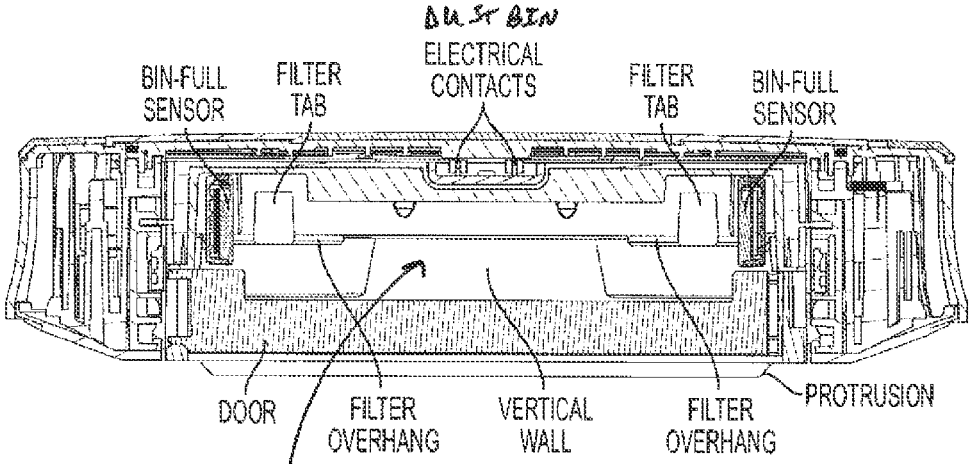
FIG. 3A is a cross-sectional view of the robotic vacuum of FIG. 2.

FIG. 3A is a cross-sectional view of the robotic vacuum of FIG. 2, with the dust bin installed, in the direction of the installed dust bin. This cross-sectional view illustrates a location of bin-full sensors within the robotic vacuum chassis. The bin-full sensors may detect whether the dust bin is full, for example, or may detect that a large object has entered the robotic vacuum chassis and become lodged. In prior art robotic vacuums, bin-full sensors (when provided) were typically located in or on the removable dust bin and thus were powered by the robotic vacuum chassis power source via electrical connections between the dust bin and the chassis. Bin-full sensors located in or on the dust bin had to send the bin-full signal wirelessly or via a communication line that had to be plugged into the chassis each time the dust bin was installed in the chassis, potentially increasing cost and decreasing reliability. Bin-full sensors located in or on the robotic vacuum chassis, such as those illustrated in FIG. 3A, can receive power directly from the remote vehicle power source and can send a bin-full signal, for example, to a robotic vacuum controller, via a wired connection (see FIG. 12).

Figure 4:
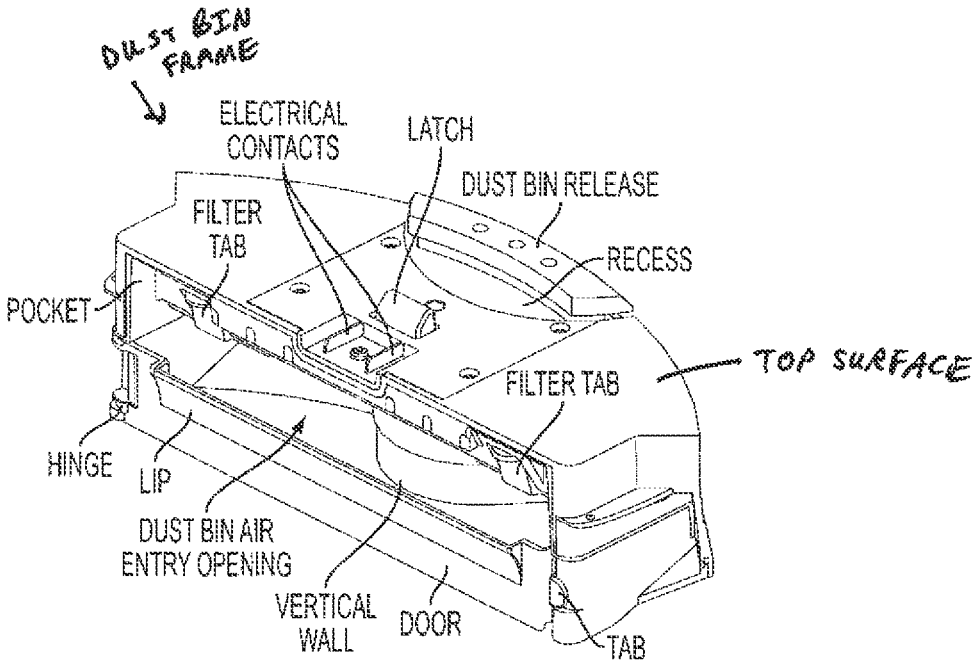
FIG. 4 is a side perspective view of an embodiment of a dust bin separate from the robotic vacuum in accordance with the present teachings.

The present teachings contemplate that, although the bin-full sensors are located on the robotic vacuum chassis, the bin-full sensors extend into a throat or intake area of the dust bin so that the bin-full sensors can detect whether the throat or intake area is obstructed, which can indicate that the bin is full or that a large object has entered the chassis and is lodged in the dust bin throat or intake area. In robotic vacuums that also employ a piezo sensor to sense objects in the dust bin throat or intake area, the piezo sensor may not detect certain low-density objects such as hair, paper, and cotton balls. In certain embodiments of the present teachings, the bin-full sensors can replace or assist the piezo large-object sensor. The bin-full sensors can, for example, nest in pockets or recesses located on the sides of the dust bin, one of which is shown in FIG. 4. The bin-full sensors can comprise, for example, optical sensors, such as infrared (IR) sensors, photodetectors, fiberoptic sensors, or interferometers.

In accordance with certain embodiments, the bin-full sensors can be provided as an add-on feature or sold separately as an accessory. The bin-full sensors are preferably removable and may need to be plugged into the robotic vacuum chassis to receive power from the robotic vacuum and provide a wired bin-full signal. It may also be desirable to provide a seal for the bin-full sensors against dust that could cloud the optical path of the bin-full sensors and reduce a maximum signal level of the sensors. The bin-full sensors provide a modular sensor assembly in the dirt path that is removable. The present teachings contemplate the bin-full sensor assembly being wired or wirelessly in communication with a robotic vacuum controller, and powered by a dedicated power source or a main robotic vacuum power source.

In certain embodiments, a labyrinth-type seal (not shown in detail) can be provided between the lid and the housing of each bin-full sensor. A labyrinth-type seal can be locked into place when the bin-full sensors are installed.

It is desirable to have the sensors located in the dust bin for bin-full sensing. However, it is preferable to have the sensors outside of the dust bin to serve as a large object detector. The present teachings therefore provide sensors on the robot chassis, nested in pockets around a throat area of the dust bin, to provide suitable bin-full sensing and large-object detection.

When IR sensors are used for bin-full sensing and/or large-object detection, it is preferable to use IR transparent or black material (e.g., plastic) in the throat or intake area. With an IR transparent material, the IR sensors can be either inside or outside of the throat or intake area. The present teachings, however, contemplate a variety of materials for the throat or intake area that allow the bin-full sensors to work. In accordance with certain embodiments, the bin-full sensor housing comprises IR-black material and the lid comprises IR-transparent material. The goal is to limit cross talk and stray signals from outside of the optical path.

FIG. 3A shows the accessibility of filter tabs to a user to remove air filters, the filter tabs being located on each side of a central housing for the impeller. When the dust bin is removed from the robotic vacuum chassis, the user can easily access the filter tabs through the entrance of the dust bin to remove the filters by, for example, pulling the tabs (see also FIG. 4) downward using a tip (see FIG. 7) of the tab. As shown in FIG. 3A, the filters do not extend across the dust bin cavity in a manner common in prior art robotic vacuums. Instead, the filters are seated within the dust bin on either side of a centrally-located impeller housing, so that only the overhang portion of each filter housing protrudes into the dust bin cavity of the dust bin, the overhang portion preferably providing a seal with the dust bin. In certain embodiments of the present teachings, the pull of the impeller-driven air will pull the filter tight to the seal and thus enhance the seal between the impeller housing and the filters.

Figure 3B:
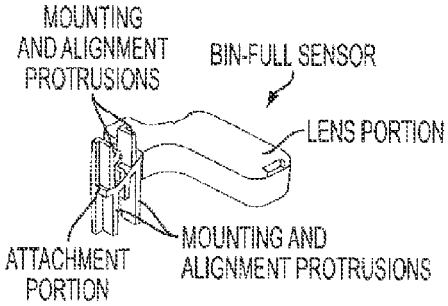
FIG. 3B is a side perspective view of an embodiment of a bin-full sensor in accordance with the present teachings.

FIG. 3B is a side perspective view of an embodiment of a bin-full sensor shown in FIG. 3A in accordance with the present teachings. As shown, the illustrated embodiment includes, for each sensor (a pair of sensors being shown in FIG. 3A), a lens portion and an attachment portion. The lens portion includes a housing, a circuit board with transmitters and receivers (see FIG. 3D), an optical gasket, and a lid that allows transmitted and received light (e.g., IR light) to pass through but does not focus or disperse the light (e.g., IR light). The illustrated attachment portion includes, on one side thereof, a relatively H-shaped set of mounting and alignment protrusions, which can be configured to slide into friction-fit or locking engagement with recesses in the robotic vacuum chassis, for example in the general area specified in FIG. 3A. In addition to providing mounting and alignment, the protrusions also provide a suitable amount of strength to the attachment portion of each bin-full sensor. The lens portion is shown and disclosed in more detail with respect to FIG. 3C.

Figure 3C:
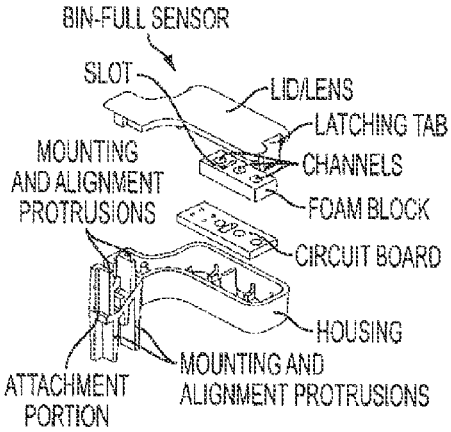
FIG. 3C is an exploded view of the bin-full sensor of FIG. 3B.

FIG. 3C is an exploded view of the bin-full sensor of FIG. 3B, which for exemplary purposes includes an IR sensor. The illustrated embodiment includes a housing and a lid, the lid having at least one latching tab with a barb that allows the lid to lockingly engage the housing when the lid is inserted into/onto the housing. In a preferred embodiment, a latching tab is also provided at least on another side of the lid to more securely lock the lid to the housing. The lid and the housing can be sealed in other ways such as, for example, by adhesives, welding, fasteners, and other types of snap-fit latching mechanisms. The lid is preferably IR transparent, allowing IR beams to pass into and out of the sensor.

Figure 3D:
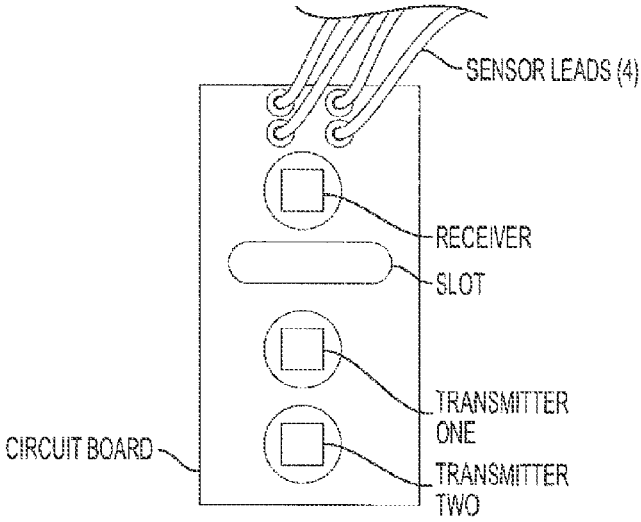
FIG. 3D is a top view of an exemplary circuit board for use in the bin-full sensor of FIG. 3B.

Within the lens portion is a circuit board, shown in FIG. 3D, having sensor leads, a receiver, two transmitters, for example, and a locating slot to receive a locating protrusion extending within the housing (see FIG. 3C). The locating protrusion extends upwardly within the housing and can serve to insulate the receiver from the transmitters, properly locate the circuit board within the housing, and align the circuit board with an optical gasket (e.g., a foam block). In certain embodiments, performance of the sensor can be enhanced by providing the optical gasket (e.g., a foam block) to minimize cross talk among IR transmissions. The optical gasket can comprise a variety of opaque materials that are capable of acting as a blind. Certain embodiments of the present teachings utilize foam because foam is forgiving and provides a good optical seal when assembled under compression. The optical gasket can have multiple channels (e.g., cylindrical holes) therethrough for the IR transmission, with material between the channels preventing or minimizing cross talk among channels.

In certain embodiments of the present teachings, a bin-full sensor housing boot (not shown) can be designed to releasably fit over the mounting and alignment protrusions of the bin-full sensor assembly to plug and seal an opening into the interior of the robotic vacuum chassis to prevent debris and moisture from entering the robotic vacuum chassis. The boot can also be configured to plug and seal an opening for the bin-full sensor when the bin-full sensor is not installed in the robotic vacuum chassis.

FIG. 4 is a side perspective view of an embodiment of a dust bin in accordance with the present teachings. A top surface of the dust bin includes the dust bin release, the latch to releasably lock the dust bin within the robotic vacuum chassis, the dust bin recess as described above, and the electrical contacts to provide electrical power from the robotic vacuum's main power source to an impeller motor within the dust bin. FIG. 4 also illustrates a pocket into which a bin-full/large-object sensor attached to the robotic vacuum chassis can be seated when the dust bin is installed in the chassis cavity. The pocket allows the bin-full sensor to be seated in a location that is suitable for bin-full sensing as well as large-object sensing. The present teachings contemplate a pocket being provided on each side of the dust bin air entrance/opening, above the location of a door for the dust bin.

The door is preferably provided on a bottom portion of the dust bin. The door retains debris within the dust bin when the dust bin is removed from the robotic vacuum chassis and is transported for emptying. In the illustrated embodiment, the door is hinged on one side of the dust bin, and latched on the other side of the dust bin via a snap-fit, friction-fit, or other releasable locking engagement mechanism. One of ordinary skill in the art would recognize that the door may be hingedly attached at other than one side of the door, for example, at a bottom portion of the door so that the door may swing downward when the dust bin is to be emptied. A tab may be provided on the side of the door that is releasably locked, for use in releasing the door from its locking engagement. In certain embodiments, the door can include an outwardly-extending lip, as shown in FIG. 4, to direct debris into the dust bin to improve debris capture. The outwardly-extending lip can also be used to dislodge debris trapped in one or more cleaning head brushes when the brush and/or debris strike the lip, as described in U.S. Patent Publication No. 2010/0037418, the entire content of which is incorporate herein by reference.

The embodiment of FIG. 4 shows a vertical wall centrally located within the dust bin. The vertical wall houses a centrally-located impeller and impeller motor (shown in FIGS. 5A and 5D). In certain embodiments, the vertical wall is preferably rounded to maximize bin volume and to divert air to either side of the dust bin with less turbulence being created than if the vertical wall had two or more corners (i.e., was box-shaped). Air carrying debris enters the dust bin through the air entry opening above the door and between the bin-full sensor pockets, deposits most or all of the debris into the bottom of the dust bin, and is pulled to the left or to the right of the vertical wall where the air heads upward and through the air filter to be cleaned (see FIG. 5C) before passing through the impeller and out through the exhaust.

FIG. 4 also shows the accessibility of the air filter tabs through the opening of the dust bin. A user can easily see the tabs and access them to pull the tabs down at the tip, for example, to remove the filter from the dust bin.

Figure 5A:
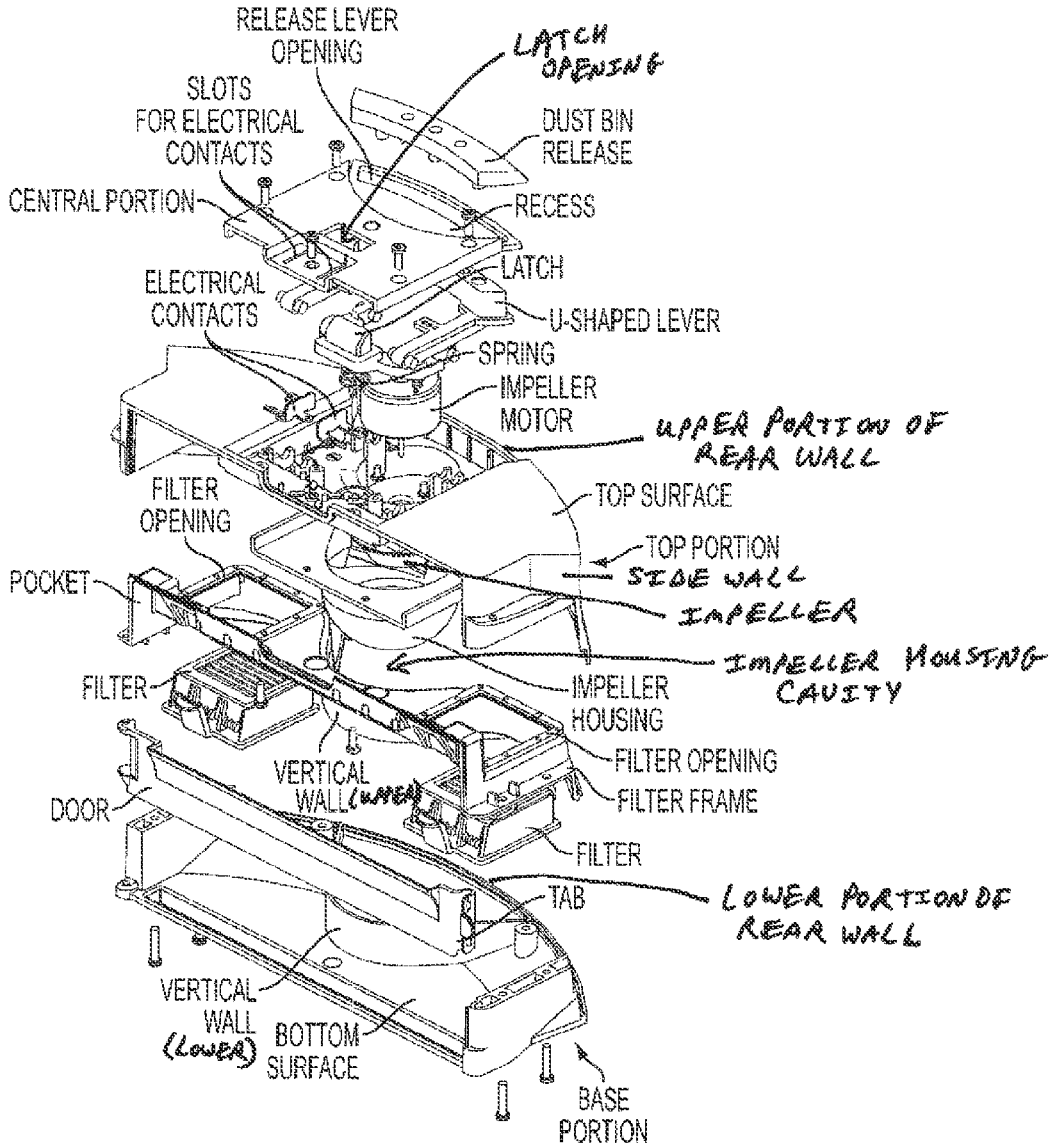
FIG. 5A is an exploded view of the dust bin of FIG. 4.

FIG. 5A is an exploded view of the dust bin of FIG. 4. In the illustrated embodiment, the dust bin includes: (1) a base portion including the dust bin bottom surface, side walls, a lower portion of a rear wall, and a lower portion of a vertical wall; (2) a top portion including the top surface of the dust bin, side walls and an upper portion of a rear wall; (3) a filter frame configured to be attached to a top of the base portion and including filter openings defined therein at opposite sides of the filter frame, and an upper portion of the vertical wall; (4) filters configured to be received into the filter openings of the filter frame; (5) an impeller housing cavity defined by the vertical wall of the filter frame and the base portion, and the rear wall of the filter frame and the top portion; (6) an impeller housing that can be seated within the impeller housing cavity created by the vertical wall and the rear wall; (7) an impeller motor configured to be received within the impeller housing; and (8) a detachable door that may optionally be hingedly attached to the base portion or attached in any manner known to one of ordinary skill in the art to maintain the door in a connected state with the base portion.

Figure 9:
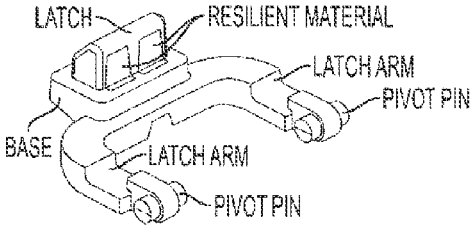
FIG. 9 is a perspective view of a dust bin locking mechanism in accordance with certain embodiments of the present teachings.
Figure 10:
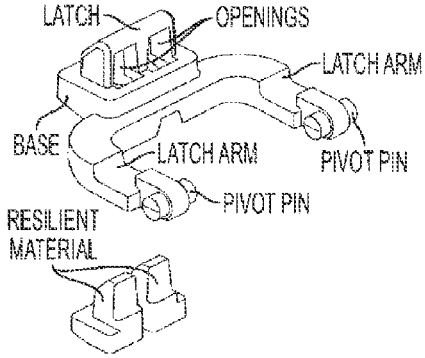
FIG. 10 is an exploded view of the dust bin locking mechanism of FIG. 9.

The top surface of the dust bin embodiment illustrated in FIG. 5A includes a central portion having a recess and a release opening into which a bottom portion of a dust bin release extends when the dust bin is assembled. The bottom portion of the release can be attached to a U-shaped lever having pins about which the U-shaped lever can pivot, the U-shaped lever being attached to arms connected to a latch that releasably engages the robotic vacuum chassis, the latch arms also having pins about which the latch arms can pivot. Once assembled, pressing down on the dust bin release causes the U-shaped lever to pivot about its pivot pins, which then causes the latch arms to pivot about their pivot pins and lower the latch so that the dust bin is released from the robotic vacuum chassis. An embodiment of the latch and the latch arms is illustrated in FIGS. 9 and 10.

The dust bin release that is visible to the user on a top surface of the robotic vacuum comprises only a portion of the release mechanism to release the dust bin from the robotic vacuum chassis, which is referred to herein as the dust bin locking mechanism and can comprise, as shown in FIG. 5A, the dust bin release, the U-shaped lever, and the base and arm assembly (see FIGS. 9 and 10) from which the latch extends.

The central portion of the illustrated dust bin top surface also includes a recess in which two slots, for example, are located to receive electrical contacts. One of ordinary skill in the art would recognize that fewer more electrical contacts and slots may optionally be provided. The electrical contacts are configured to mate with contacts located within the robotic vacuum chassis cavity (see FIG. 2) so that power is able to be provided to the impeller motor from a power source (see FIG. 12) located in the robotic vacuum chassis.

Figure 5B:
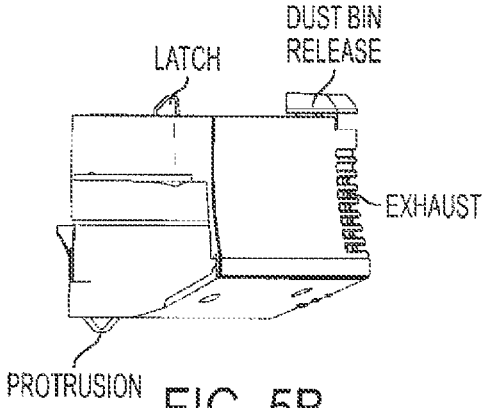
FIG. 5B is a side view of the dust bin of FIG. 4.

FIG. 5B is a side view of the dust bin of FIG. 4, showing the latch and the dust bin release extending upwardly from the top surface of the dust bin, the exhaust area located in the back wall of the dust bin, and the protrusion extending downwardly from a bottom surface of the dust bin. The door lip can also be seen.

Figure 5C:
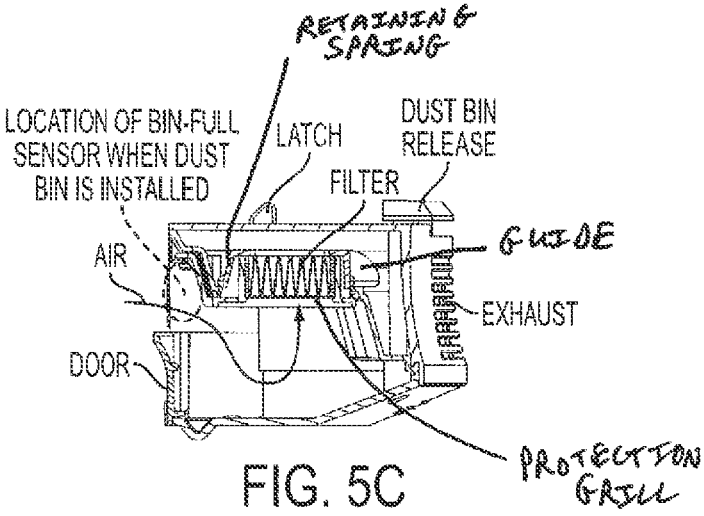
FIG. 5C is a cross-sectional view of the dust bin of FIG. 4.

FIG. 5C is a cross-sectional view of the dust bin of FIG. 4, showing a cross section through one of the air filters. The direction of intended air travel through a portion of the dust bin is indicated. Due to the position of the door in relation to the dust bin cavity, the intake air makes a sharp turn downward upon entering the bin and then passes upward through the protection grill into the filter. The dust bin door and its lip can be seen in cross section, as well as the air filter. The latch and the dust bin release are shown extending upwardly from the top surface of the dust bin, along with the exhaust area located in the back wall of the dust bin, and the protrusion extending downwardly from a bottom surface of the dust bin.

Figure 5D:
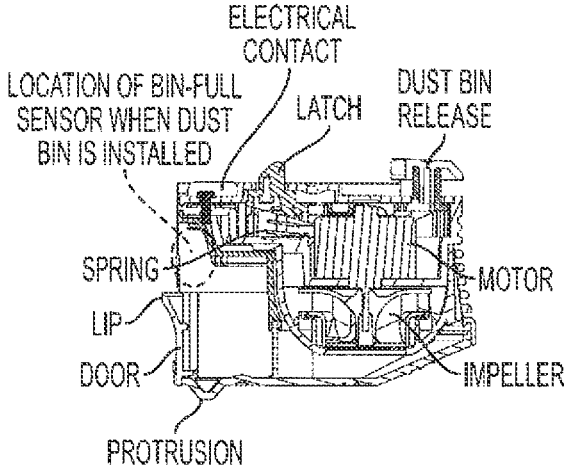
FIG. 5D is another cross-sectional view of the dust bin of FIG. 4.
Figure 6:
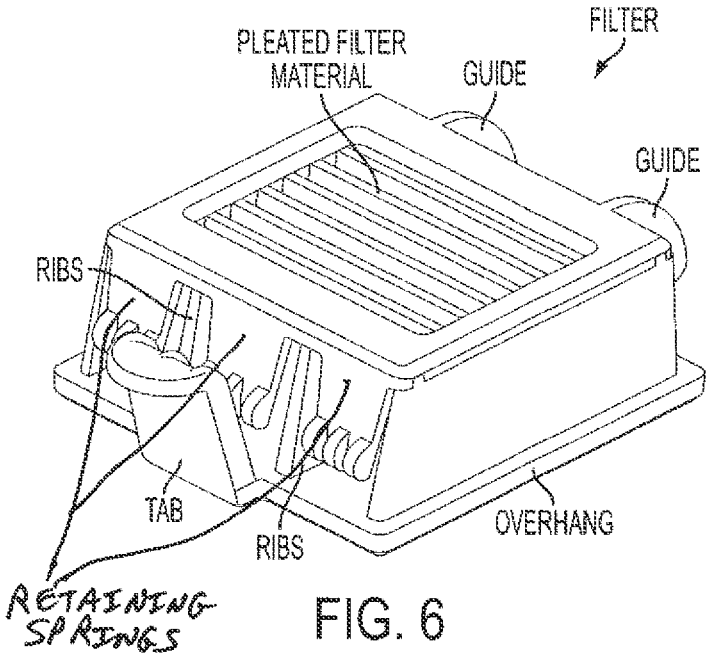
FIG. 6 is a top perspective view of an embodiment of a filter in accordance with the present teachings.

FIG. 5D is another cross-sectional view of the dust bin of FIG. 4, showing a cross section through the center of the dust bin, showing at least a portion of the latch with its base and latch arms, the dust bin release, the U-shaped lever, the impeller, the impeller motor, and the impeller housing. The door and its lip can also be seen in cross section, as can the protrusion extending from the bottom surface of the dust bin. FIGS. 5A and 5D also show a coil spring under the latch that biases the latch into an upward (locking) position. Pressing in the dust bin release presses the latch downward to an unlocked position against the biasing force of the coil spring.

FIGS. 6, 7, and 8A-8C illustrate an embodiment of an air filter in accordance with the present teachings. As shown, the air filter includes a housing portion including a top surface and four generally vertical walls. The air filter also includes a filter cover and retaining springs extending from the filter cover that are configured to deflect during insertion of the air filter into the filter frame, creating a reliable friction fit or even a snap fit to retain the air filter properly within the filter frame.

In certain embodiments, guides (which can also be referred to as retention tabs) can be provided on a rear wall of the cover, for example, on a wall of the cover opposite the retainer springs, to assist the user in correctly inserting the air filter within the dust bin and prevent latching of an incorrectly inserted filter. Complementary grooves can be provided in the dust bin to receive the guides.

In various embodiments, the top surface of the air filter extends beyond the walls, for example on all four sides of the air filter, to provide an overhang (or sealing flange) that allows the air filter to be seated within the filter opening and sealed with respect to the filter frame around the filter opening. The overhang can also be referred to as a sealing flange, because the overhang provides a seal surface to seal the air filter to the filter frame. This type of seal can be referred to as a 'face seal.' The overhang is preferably provided on all four sides of the housing, but there need only be enough overhanging surface to retain the air filter in the air filter frame. The overhang or sealing flange can make the air filter more forgiving of manufacturing part size variation.

Figure 7:
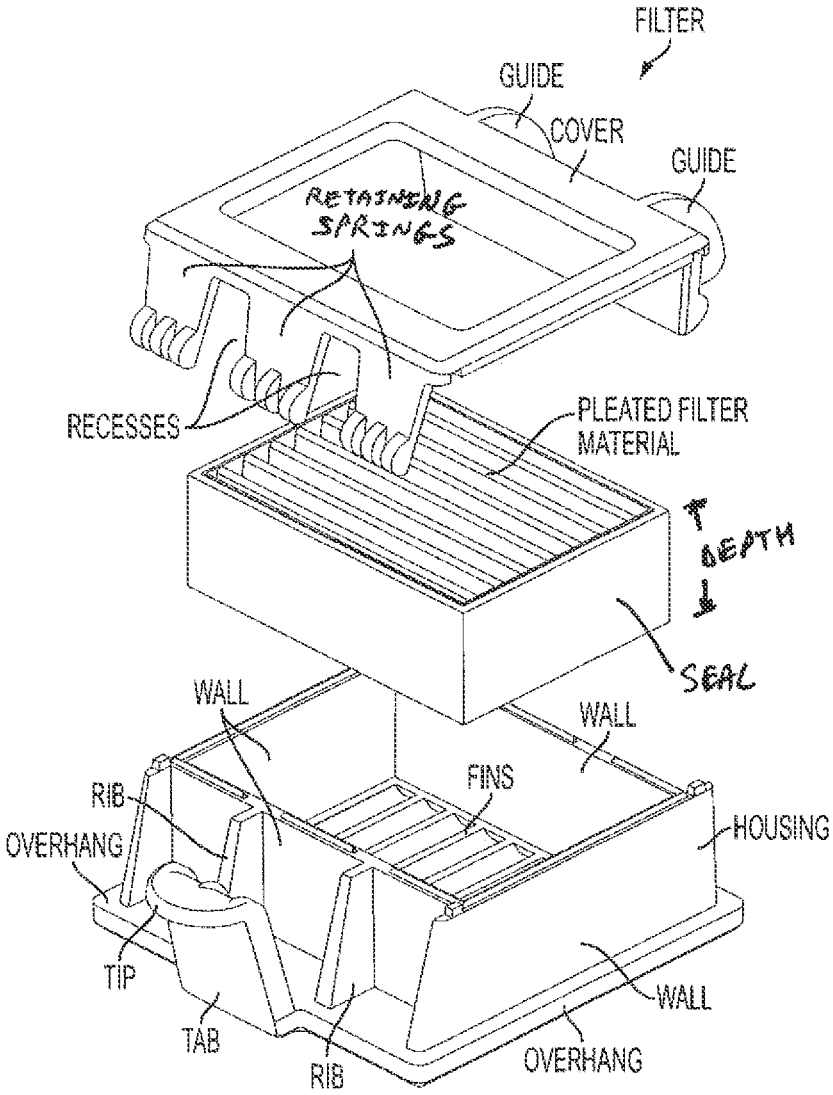
FIG. 7 is an exploded view of the filter of FIG. 6.
Figure 8A:
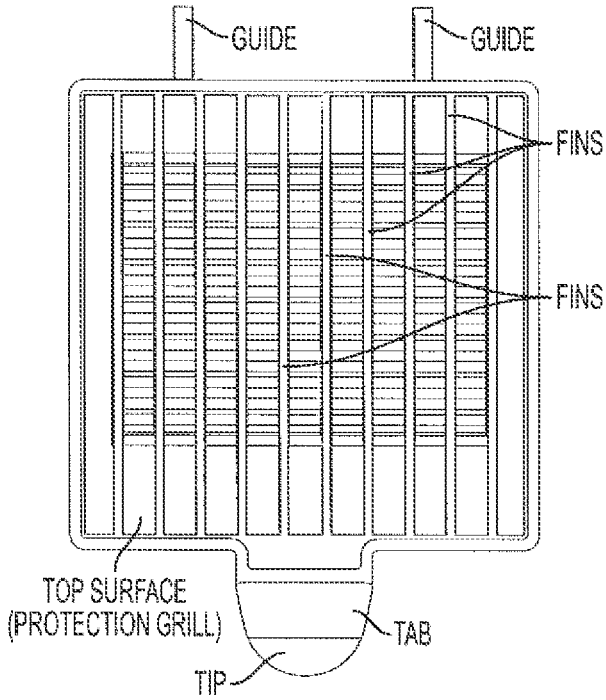
FIG. 8A is a top view of the filter of FIG. 6.
Figure 8B:
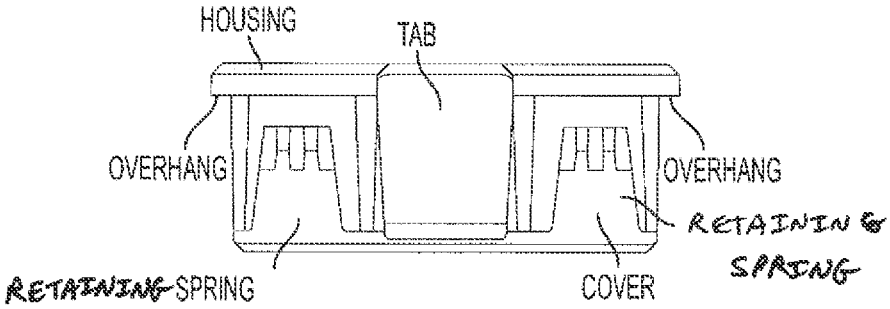
FIG. 8B is a front view of the filter of FIG. 6.
Figure 8C:
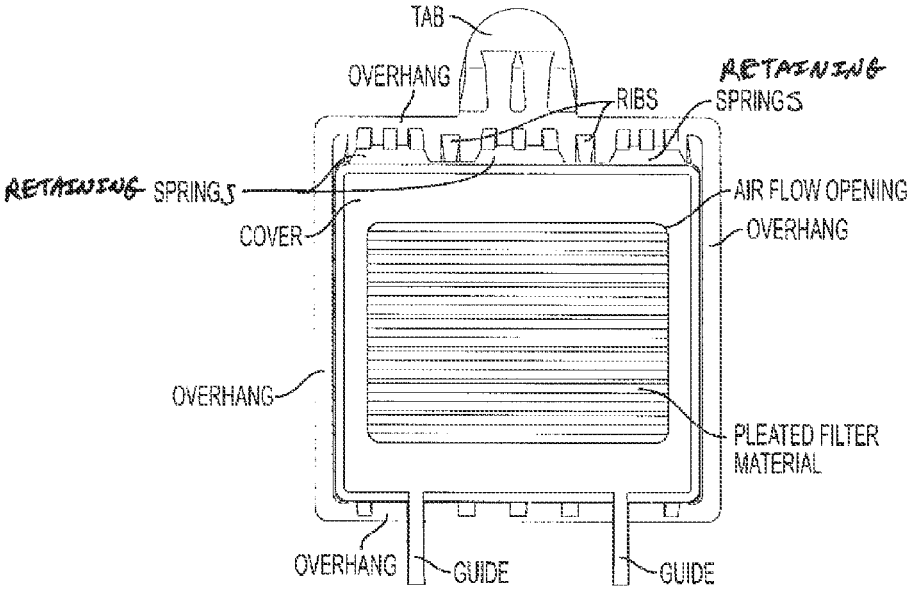
FIG. 8C is a bottom view of the filter of FIG. 6.

Filter material can be inserted into the air filter housing, for example, the pleated square of filter material shown in FIG. 7. Pleating the filter material increases surface area to reduce drag and to extend the filter life. In certain embodiments of the present teachings, the pleated filter material can have a depth in the direction of air flow of about 0.5 cm or more. In various embodiments, the air filter can be a high efficiency particulate air (HEPA) filter or a pleated filter meeting HEPA standards. In certain embodiments, a circumferential seal can be provided to seal the filter material within the filter housing and prevent air from passing through the filter housing without being filtered by the filter material.

Because filter size takes away from dust bin capacity, the compact size of the illustrated air filters helps maximize dust bin capacity without creating an excessive amount of drag. As one skilled in the art can appreciate, a dirty air filter can cause a starved impeller to create a zone of low pressure and spin faster. When this happens, current drops with the reduced motor load (because the motor is moving less air). The present teachings contemplate using motor current to indicate when filters are dirty.

Fins on the top surface (see FIG. 8A) of the filter can create a protection grill and preferably extend orthogonal to the filter pleats to maximize air flow through the air filter while also protecting the air filter material from being crushed, for example, by a user's fingers during installation or inspection. Arranging the fins parallel to the filter pleats was found to restrict airflow. The fins can obviate the need for a pre-filter in the dust bin, although a pre-filter can be employed in a dust bin of the present teachings. Indeed, certain spacings of the protection grill fins can laminarize air flow into the filter and reduce flow resistance.

The filter cover is provided to retain the filter material within the filter housing. As stated above, the illustrated filter cover (see FIG. 7) includes two guides to ensure proper insertion of the air filter into the filter frame, an airflow opening, retaining springs, and two recesses defined between the retaining springs to receive ribs extending from the housing. The housing and the cover can comprise a variety of suitable materials, for example plastic, metal, or a composite, and the housing and cover can be molded and then attached to each other via, for example, a snap-fit connection, an adhesive, fasteners, or welding, but the attachment is not limited thereto and may be any method of attaching the housing and the cover together.

The air filter embodiment illustrated in FIGS. 6, 7, and 8A-8C can be beneficial because the filter(s) need not separate the dust bin into two parts, and therefore increase the available cavity volume and make it easier for users to empty the bin. In addition, prior art air filters typically slide into a track formed in the dust bin, and this arrangement can require more sealing than an air filter arrangement in accordance with the present teachings, and may not work well in dirty environments when the track in which the filter slides becomes clogged with debris. The snap-fit filter is inserted upward into a top surface of the dust bin cavity and does not need to slide along tracks that may become clogged with dirt. The "snap-fit" type filter assembly of the present teachings uses a vacuum-assisted seal to hold the filter in, and thus less sealing pre-load and/or surface is required. The most desirable sealing to utilize under vacuum pressure is a face seal in a direction such that the vacuum assists sealing, which is the type of seal employed between the filter frame and the air filter embodiment illustrated in FIGS. 6, 7, and 8A-8C.

FIG. 9 is a perspective view of a portion of a dust bin locking mechanism in accordance with certain embodiments of the present teachings. As shown, the dust bin locking mechanism includes a latch, a base, and a U-shaped portion extending from the base. The U-shaped portion includes two latch arms and a pivot pin at a distal end of each arm, allowing the arms to pivot downwardly when a downward force is applied thereto, for example, by pressing a dust bin release that directly or indirectly drives the latch downward to release the dust bin from the robotic vacuum chassis.

The latch may optionally be a jam latch, for example, as illustrated in the locking mechanism embodiment of FIGS. 9 and 10. The jam latch is configured to prevent the dust bin from inadvertently disengaging from the robotic vacuum chassis, for example, when the robotic vacuum is picked up by the bin release. The jam latch is configured to lock the dust bin locking mechanism when the weight of the robotic vacuum causes engagement of the jam latch in a different direction than a direction of dust bin locking mechanism release. The weight of the robotic vacuum thus engages a directional lock. The jam latch (directional lock) can comprise, for example as shown in FIGS. 9 and 10, one or more openings defined within the jam latch and a resilient material disposed within the openings of the jam latch. The resilient material within the openings of the jam latch can be accessed by a detent (see FIGS. 11A and 11B) located on the robotic vacuum chassis. The detent can access the resilient material via the one or more openings in the jam latch when driven thereinto by the weight of the robotic vacuum chassis. The dust bin locking mechanism including, e.g., the jam latch, and the detent together comprise a directional locking assembly to maintain the dust bin and the robotic vacuum chassis in an engaged state even when the robotic vacuum is picked up by the bin release.

Figure 11A:
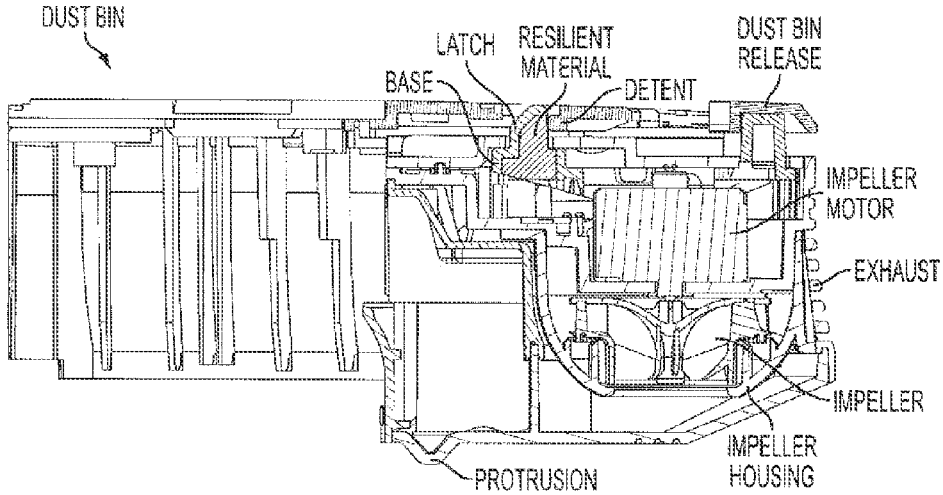
FIG. 11A is a cross-sectional view of an embodiment of a robotic vacuum in accordance with the present teachings, wherein the dust bin locking mechanism of FIG. 9 is not engaged.
Figure 11B:
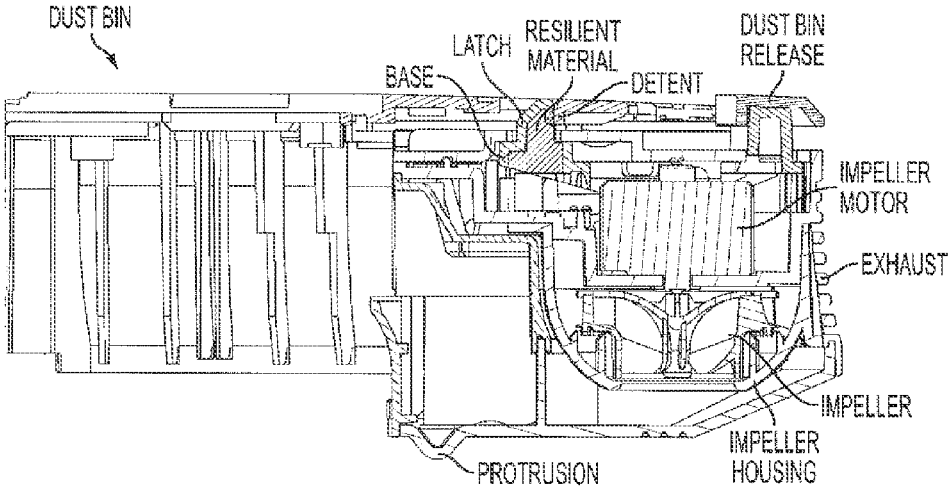
FIG. 11B is a cross-sectional view of an embodiment of a robotic vacuum in accordance with the present teachings, wherein the dust bin locking mechanism of FIG. 9 is engaged.

FIG. 11A shows a dust bin when the jam latch is not engaged. As shown, a detent merely rests against the resilient material and therefore does not engage the resilient material. Therefore, the latch is free to move in a downward direction when the dust bin release is pressed to release the dust bin from the robotic vacuum chassis. FIG. 11B shows a dust bin when the jam latch has been engaged, for example, from the weight of the robotic vacuum chassis having pulled the detent into the resilient material, as would happen when the robotic vacuum is picked up by the dust bin, for example, by the dust bin release. As shown, the detent presses into, e.g., engages with, the resilient material to prevent the latch from moving in a downward direction to release the dust bin from the robotic vacuum chassis. The detent engages the jam latch in an orthogonal direction with respect to a direction of release of the jam latch.

Other embodiments of the present teachings will be apparent to those skilled in the art from consideration of the specification and practice of the teachings disclosed herein. For example, the present teachings apply to a robotic vacuum having a single brush or a single brush having a structure in accordance with the present teachings, and to robotic vacuums having more than two brushes. It is intended that the specification and examples be considered as exemplary only, with a true scope and spirit of the present teachings being indicated by the following claims.

What is claimed is:

1. A dust bin for a robotic vacuum, the dust bin comprising:

a dust bin frame having a cavity defined therein to receive debris;

a filter frame disposed within the dust bin frame and defining two filter openings at opposite sides thereof;

a central impeller disposed adjacent to or under the filter frame to draw air from outside of the dust bin into the dust bin; and two air filters, one air filter being located on each side of the central impeller, each air filter being inserted into one of the filter openings, each filter having an overhang around a perimeter thereof that includes a sealing face to form a vacuum-assisted seal with the filter frame when air is drawn into the dust bin.

2. The dust bin of claim 1, wherein the air filters comprise pleated filter material.

3. The dust bin of claim 2, wherein the pleated filter material has a depth in a direction of air flow of about 0.5 cm or more.

4. The dust bin of claim 2, wherein each air filter comprises a protection grill having multiple fins arranged in parallel.

5. The dust bin of claim 4, wherein the fins of the protection grill are arranged orthogonal to pleats of the pleated air filter material.

6. The dust bin of claim 1, wherein the air filters are each held within the filter frame by a friction or snap fit.

7. The dust bin of claim 1, further comprising a hinged door configured to be opened to empty the contents of the dust bin.

8. The dust bin of claim 7, wherein the hinged door comprises an outwardly-extending lip to direct debris into the dust bin cavity.

9. The dust bin of claim 1, wherein each air filter comprises a tab configured to assist a user in removal of the air filter from the dust bin.

10. The dust bin of claim 1, wherein each air filter comprises retainers configured to retain the air filter in the filter frame.

11. The dust bin of claim 1, wherein each air filter comprises guides configured to be received into the dust bin and facilitate in proper insertion of the air filter into the dust bin.

* * * * *